US006012827A

United States Patent [19]

Caplan et al.

[11] Patent Number: 6,012,827

[45] Date of Patent: Jan. 11, 2000

[54] MOUNTING APPARATUS FOR HEAD- AND BODY- BORNE OPTICS AND ILLUMINATION DEVICES

[75] Inventors: Charles H. Caplan, Middleton, Wis.; Frederick N. Bushroe, Tucson, Ariz.

[73] Assignee: Surgical Acuity, Inc., Madison, Wis.

[21] Appl. No.: 08/918,398

[22] Filed: Aug. 26, 1997

Related U.S. Application Data

[60] Provisional application No. 60/025,042, Aug. 26, 1996.

[51] Int. Cl.[7] ..... F21V 21/00

[52] U.S. Cl. ..... 362/396; 362/419; 362/103; 362/105

[58] Field of Search ..... 362/419, 103, 362/105, 396, 106, 430, 438; 600/249; 2/422

[56] References Cited

U.S. PATENT DOCUMENTS

| | | | |
|---|---|---|---|
| D. 296,337 | 6/1988 | Caplan . | |
| 558,889 | 4/1896 | Wittman . | |
| 608,109 | 7/1898 | Dow . | |
| 2,226,941 | 12/1940 | Montalvo-Guenard . | |
| 3,285,242 | 11/1966 | Wallace . | |
| 3,350,552 | 10/1967 | Lawrence . | |
| 3,830,230 | 8/1974 | Chester . | |
| 3,951,139 | 4/1976 | Kloots . | |
| 4,234,910 | 11/1980 | Price . | |
| 4,274,128 | 6/1981 | Malis . | |
| 4,488,790 | 12/1984 | Beecher . | |
| 4,568,154 | 2/1986 | Beecher . | |
| 4,616,257 | 10/1986 | Kloots et al. . | |
| 4,797,736 | 1/1989 | Kloots et al. . | |
| 4,865,438 | 9/1989 | Wada . | |
| 5,341,513 | 8/1994 | Klein et al. . | |
| 5,344,115 | 9/1994 | Mayne et al. | 248/514 |
| 5,381,263 | 1/1995 | Nowak et al. . | |
| 5,430,620 | 7/1995 | Li et al. . | |
| 5,541,767 | 7/1996 | Murphy et al. . | |
| 5,667,291 | 9/1997 | Caplan et al. | 362/105 |

*Primary Examiner*—Nimeshkumar D. Patel
*Assistant Examiner*—Michael J. Smith
*Attorney, Agent, or Firm*—Fitch, Even, Tabin & Flannery

[57] ABSTRACT

A mount for affixing devices such as lightweight illuminators to spectacles is described. The mount includes a pair of opposable jaws pivotably affixed together about a pivot axis, the jaws being intended for affixation about spectacles (e.g., the nosebridge of spectacles), and a mounting yoke pivotably affixed to the clip. The mounting yoke may then pivotably bear an illuminator to allow the illuminator to move in three degrees of freedom.

21 Claims, 2 Drawing Sheets

1/2

MOUNTING APPARATUS FOR HEAD- AND BODY- BORNE OPTICS AND ILLUMINATION DEVICES

CROSS-REFERENCE TO RELATED APPLICATIONS

This application claims priority under 35 USC §119(e) to U.S. Provisional Patent Application 60/025,042 filed Aug. 26, 1996, the entirety of which is incorporated by reference herein.

FIELD OF THE INVENTION

The invention is directed to a mount for attaching illuminators, accessory optics, and other devices to spectacles, headbands, and other head- and body-mounted apparata so that these devices may be used in conjunction with the head- and body-mounted apparata as the head- and body-mounted apparata are being worn. More specifically, the present invention is directed to a mount for firmly attaching illuminators to the nosebridges of spectacles so that the illuminators are aligned along the wearer's line of sight; so that the illuminators may be pivoted to an in-use position located generally in front of the user's face, or to a non-use position above the user's face; and so that the illuminators will not slip or inadvertently reposition once they are attached to the spectacles and placed in an in-use or non-use position.

BACKGROUND OF THE INVENTION

To better understand the invention, one must first understand the structure and function of the devices for which the mount is intended for use. A good example of such a device is an illuminator, a miniature high-intensity light source which is used to illuminate worksites. One exemplary illuminator is the ZEON illuminator sold by Orascoptic Research, Inc. (Madison, Wis., USA), and the illuminator illustrated and described in U.S. patent application Ser. No. 08/447,357 filed May 23, 1995 by Orascoptic Research, Inc. Thus far, the prior art has generally used dedicated mounts to attach illuminators to spectacles and other head- and body-mounted apparata, such as headbands. Where spectacles are concerned, these mounts utilize flanges which define slots wherein the frames of spectacles can be mounted, and they only allow attachment of an illuminator to particular sizes, types, and/or models of spectacles. These mounts cannot be used on all spectacles because the wide variance in spectacle frame dimensions—from thin wire frames for standard eyeglasses to thick plastic frames for safety glasses—is incompatible with the particular sizes or size ranges of frames for which each specific mount is designed to operate. However, a user may want to use an illuminator on different types of spectacles with widely different sizes and configurations during the course of work, as when switching to a new type of dental/medical procedure. As a result, when a user wants to use an illuminator on different spectacles, the mount(s) must be changed as well as the spectacles themselves. It is highly inconvenient to cease work to fit the illuminator in another mount, especially when the illuminator is being used in a time-sensitive medical or dental procedure. Additionally, because an illuminator is difficult to sterilize, it is generally undesirable for the user to reach up from a worksite to detach it from one pair of spectacles and/or mount in order to attach it to another. If the illuminator is not sterile, this can contaminate the user's hands, or alternatively the user's hands can contaminate the illuminator.

Because the prior art mounts are designed to fit on specific sizes and/or size ranges of spectacles, they also tend to slip on the spectacles after they are mounted if the mounts and spectacles are not a precise fit. This can lead to inadvertent repositioning of the illuminator's light beam, which poses the problem noted above in that the user may then be unable to reposition the illuminator in the proper orientation during a procedure without cross-contamination. Further, slippage of the mount and repositioning of an illuminator can be inconvenient or dangerous during the course of a dental or medical operation because the worksite may then lack needed illumination, and the user's hands may be occupied so that the user cannot reach up to reposition the illuminator. If slippage is significant, it can also lead to the possibility that the mount and illuminator will actually fall from the spectacles onto a worksite during the course of an operation.

Conversely, there can also be the problem that an illuminator is so firmly mounted to the spectacles that it becomes difficult to remove. Prior art mounts and illuminators can be bulky and somewhat heavy when worn on spectacle frames, and additionally the illuminators may grow hot, heating the user's forehead and causing sweat to run into the user's eyes. Therefore, it may be desirable or necessary to remove the mount and illuminator from the spectacles during the course of an operation. It may be undesirable to actually remove the spectacles themselves while doing so, e.g., in environments where safety glasses are recommended. However, the mounts may fit too tightly to allow removal without dislodging or removing the spectacles. This is particularly true when only one hand is free for use in effecting removal of the mount.

Additionally, the inventors believe that illuminators are most effectively used when their light beams coincide as closely as possible to the user's line of sight, as when the illumination is provided from a point between the user's eyes. This arrangement, which will be referred to as coaxial illumination, allows the user to view the interiors of very small cavities (e.g., a hole drilled in a tooth) without any obstructing shadows. The prior art mounts generally provide mounting for illuminators which allows only an approximation of coaxial illumination.

Prior art mounts can also be disadvantageous in that once they are affixed to spectacles, they may set the illuminator in a single fixed position, and thus orient the light beam of the illuminator in a single fixed direction. If the illuminated spot is not coincident with the area the user desires to be illuminated, the user has no remedy. As an example, if the illuminated spot is slightly too high or too low when the user wears the spectacles, the edge of the spot may be situated on a critical area on the worksite. This can be extremely irritating to the user because half of the critical area will be brightly illuminated, while the other half will be in relative darkness owing to the adjustment of the user's eyes to the bright spot.

To summarize, the prior art has thus far been unable to develop a mount which allows attachment of an illuminator to a broad range of differently-sized spectacles in a manner which allows precise positioning of the illuminator in a coaxial direction, which allows repositioning of the axis of the light beam to a desired angle, and which is highly resistant to slippage and repositioning of the illuminator on the spectacles. The present invention is intended to address these problems within a small, lightweight, and inexpensively-constructed mount.

SUMMARY OF THE INVENTION

The invention, which is defined by the claims set out at the end of this disclosure, is directed to a mount which is particularly suited for the mounting of illuminators or accessory optics (e.g., magnifying binoculars) to spectacles and other head- and body-mounted apparata. The mount includes two main parts, a clip and a mounting yoke. The clip includes first and second jaws pivotably affixed about a pivot axis in opposable relation so that they may be closed about spectacles or other head- and body-mounted apparata. The jaws are preferably spring-biased with respect to each other, i.e., in normally open or closed positions. A jaw tightening screw may extend through the first and second jaws, and may be actuated by the user to defeat the bias of the springs to drive the jaws closed or open. This arrangement is particularly advantageous because the jaw tightening screw allows fine adjustment of the tightness of the jaws about objects and a more positive grip by use of only a single hand to actuate the screw. If the jaw tightening screw is omitted and only a spring is used to bias the jaws, the force exerted by the jaws is fixed in direct proportion to the distance that the spring is stretched or compressed. The use of the jaw tightening screw allows a user to exceed (or alternatively diminish) the jaw force beyond or below that which would be produced by jaws which are only spring-biased.

In the most preferred embodiment of the mount, one of the jaws includes a hub wherein the pivot axis is situated, and the other jaw includes a sleeve which at least partially encircles the hub so that the jaws are affixed in pivotable relation about the pivot axis. Where the sleeve only partially encircles the hub, the hub may include a stop land protruding therefrom and which rests within the sleeve's path of rotation about the hub. The stop land thus serves to limit the range of relative rotation of the jaws to a preferred useful range, making it easier for users to install the mount on objects with lesser prior adjustment.

The mounting yoke has a pivot end and an opposing clevis end. The pivot end is pivotably mounted to the clip, preferably so that it also rotates about the pivot axis. This is most preferably done by defining a yoke slot in the jaws which intersects the pivot axis of the clip. The pivot end of the mounting yoke may be installed within the yoke slot so that it also pivots about the pivot axis. The yoke slot is preferably situated so that it bisects the portion of the pivot axis that rests within the clip, since this arrangement will situate the mounting yoke so that it pivots within a plane in the middle of the lateral width of the jaws. The pivot end of the mounting yoke is preferably affixed within the yoke slot by use of a fastener extending along the pivot axis within the pivot end and within a hub aperture in the clip, this hub aperture also being coincident with the pivot axis. To resist unwanted pivotal displacement of the mounting yoke during use, a resistance means is provided for exerting a compressive force on the pivot end of the mounting yoke and thereby resisting pivoting. This resistance means preferably takes the form of a compressible washer, e.g., an elastomeric washer, Belleville washer, or spring, which fits about the fastener and which exerts force along the pivot axis and onto the pivot end when compressed. The resistance means may be held in compression against the pivot end of the mounting yoke by inserting a hub plug within the hub aperture so that the resistance means is maintained in compression between the hub plug and the pivot end of the mounting yoke.

The clevis end of the mounting yoke includes a clevis wherein an illuminator (or accessory optics) may be mounted. Because the mounting yoke allows pivoting at both the pivot end and the clevis end, the illuminator may be adjusted in three degrees of freedom (forward-backward, upward-downward, and rotationally about the pivots).

Because most illuminators include illuminator cords extending therefrom, the mount also preferably includes an illuminator cord retention bracket affixed to the clip by means of an elongated leg. The retention bracket can be used to isolate the tension in the illuminator cord from an illuminator mounted on the mounting yoke, thereby preventing the mounting yoke from inadvertently being pivoted out of place if the illuminator cord is pulled.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
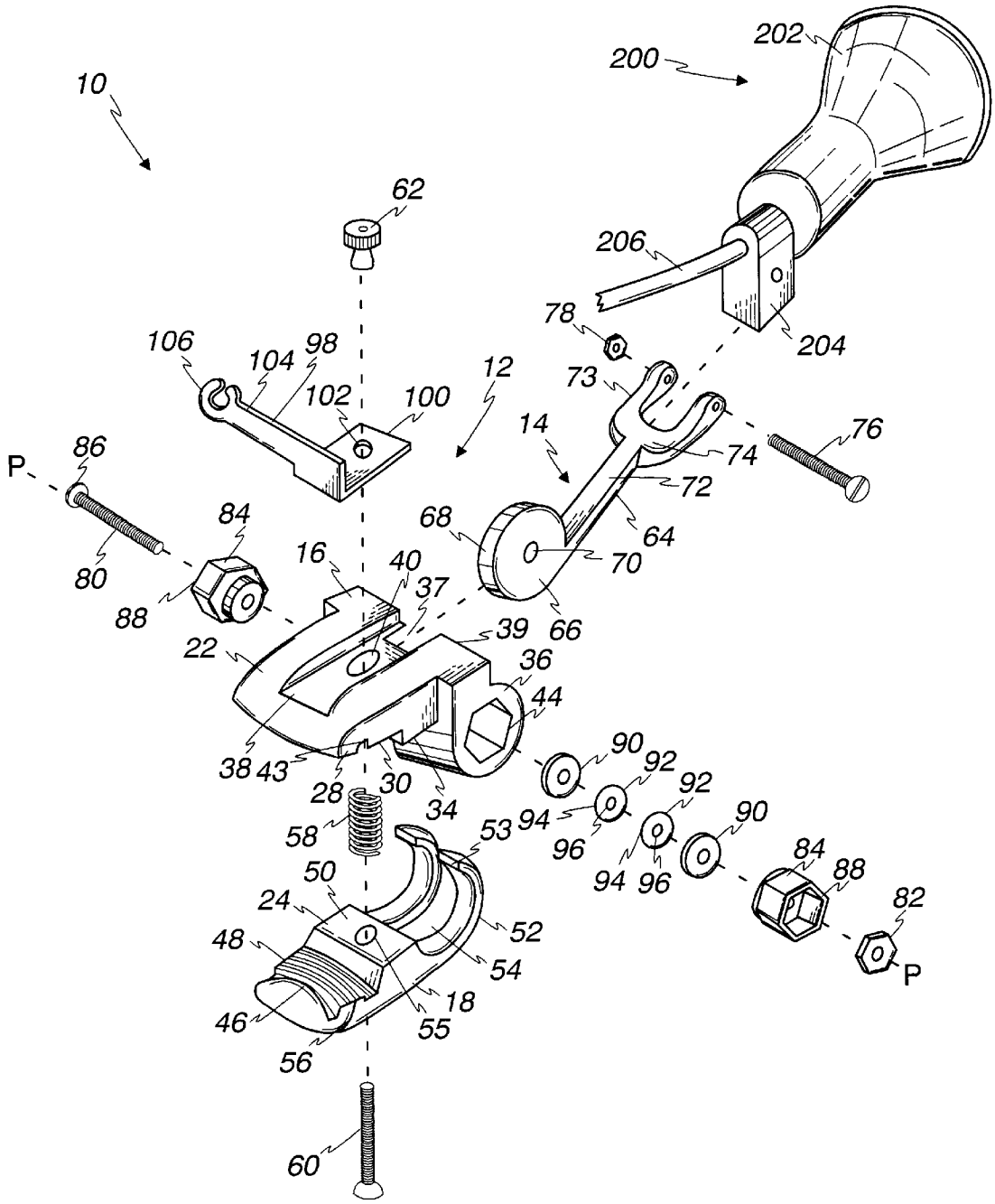
FIG. 1 is a rear exploded perspective view of a preferred embodiment of the invention.

In the drawings, wherein the same or similar features of the invention are designated in all Figures with the same reference numerals, FIG. 1 provides a rear exploded perspective view of a particularly preferred embodiment of the invention. A prior art illuminator is designated at 200, and includes illuminator optics 202, an illuminator mounting base 204, and an illuminator cord 206, which can be a fiberoptic cable or a power supply. The remaining items illustrated in FIG. 1 comprise one preferred embodiment of a mount 10. The mount 10 includes two main parts, a clip 12 and a mounting yoke 14. Each of these parts will now be discussed in turn.

Figure 2:
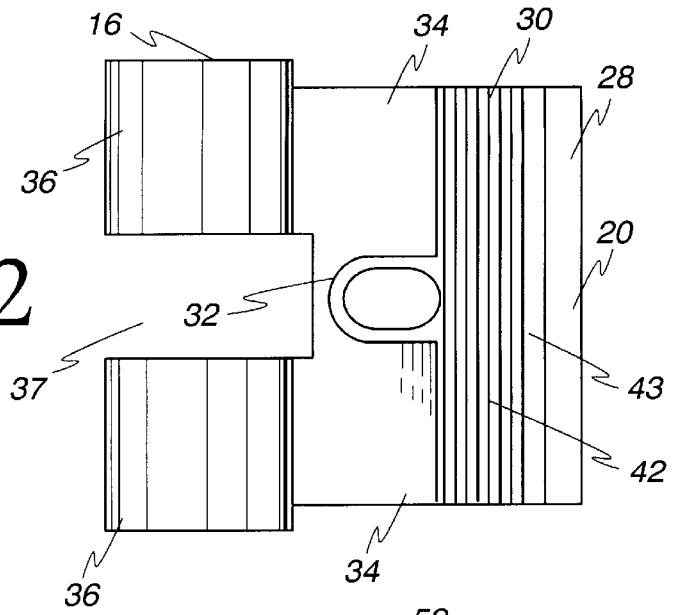
FIG. 2 is a bottom plan view of the first jaw (16) of the embodiment of FIG. 1
Figure 3:
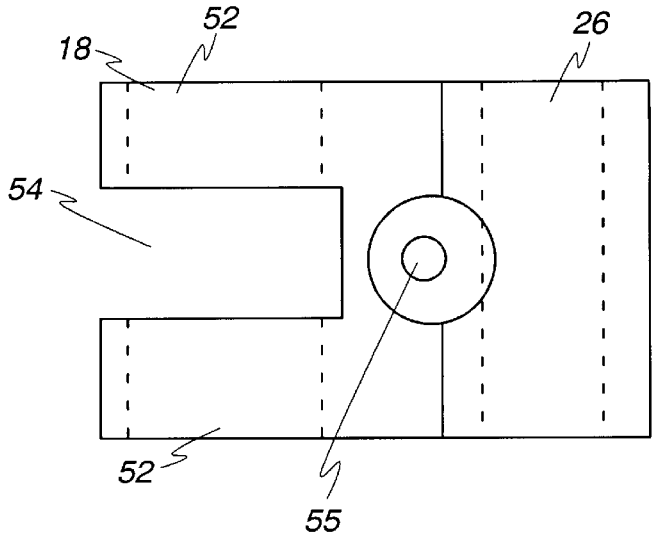
FIG. 3 is a bottom plan view of the second jaw (18) of the embodiment of FIG. 1.
Figure 4:
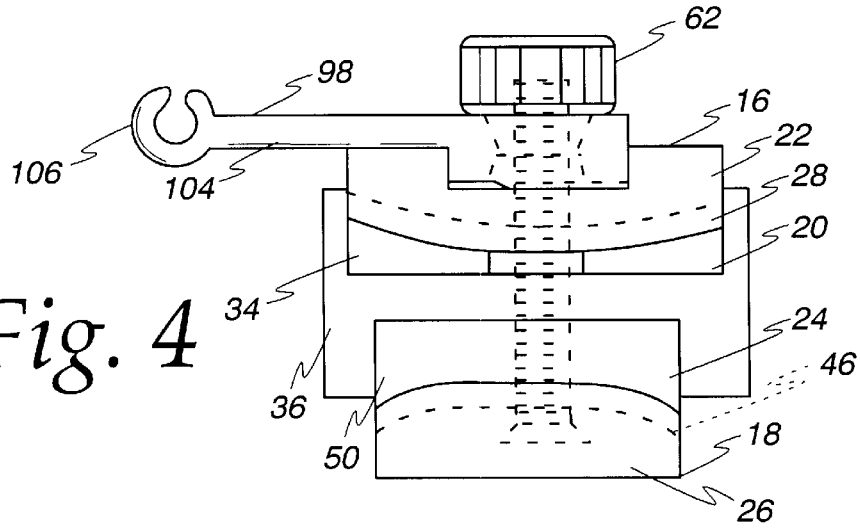
FIG. 4 is a front elevation view of the clip (12) and cord retention bracket (98) of the embodiment of FIG. 1.

The primary components of the clip 12 are a first jaw 16 and a second jaw 18, each of which are respectively illustrated in greater detail in FIGS. 2–3. Portions of the overall clip 12 assembly are also illustrated in FIG. 4. The first jaw 16 includes an inner surface 20 and an outer surface 22, and the second jaw 18 similarly includes an inner surface 24 and an outer surface 26.

As is best illustrated by FIG. 2, the inner surface 20 of the first jaw 16 includes a lip 28, a mounting land 30 depressed from the lip 28, a valley 32 raised from the mounting land 30 and located between a pair of protruding lands 34, and a pair of hubs 36. As illustrated in FIG. 1, the outer surface 22 of the first jaw 16 includes a slot 38 wherein an passage 40 extends from the outer surface 22 of the first jaw 16 to its inner surface 20 at the valley 32. The mounting land 30 includes a number of ridges 42 thereon to enhance friction with respect to a gripped object when the first and second jaws 16 are closed. A deeper ridge 43 adjacent lip 28 has been found to be helpful in assuring a firm grip on objects, particularly wire-frame spectacle nosebridges. The hubs 36 each include a hub aperture 44, which preferably has a noncircular (e.g., hexagonal) shape. The hubs 36 are laterally spaced along the pivot axis P-P (illustrated by the dashed line in FIG. 1) with an intermediate hub yoke slot 37. As will be discussed below, the mounting yoke 14 is pivotably retained within the hub yoke slot 37. The outer surfaces of hubs 36 may be interrupted by a stop land 39, the purpose of which will be discussed below.

The inner surface 24 of the second jaw 18 has a lip 46, a mounting land 48 depressed from the lip 46, a protruding land 50 raised from the mounting land 48, and a pair of sleeves 52 which are each sized to closely receive the outer surface of one hub 36 therein. The engagement between the sleeves 52 and the hubs 36 allows the first jaw 16 and second jaw 18 to engage in pivotable relation about the pivot axis P-P. The sleeves 52 illustrated in FIG. 1 are a preferred embodiment which only partially encircle the hubs 36, and which have terminal sleeve tips 53. The ability of the jaws 16 and 18 to open is limited by situating the stop land 39 along the outer surfaces of the hubs 36 and along the path of travel of the sleeve tips 53 so that the stop land 39 serves to limit the range of motion of the sleeve tips 53. Similarly to the hubs 36, the sleeves 52 are laterally spaced along the pivot axis P-P by a sleeve yoke slot 54 which receives the mounting yoke 14, as will be discussed below. The protruding land 50 includes an aperture 55 thereon which is generally coaxially aligned with the aperture 40 in the valley 32 of the first jaw 16. The mounting land 48 includes ridges 56 thereon which are generally aligned with the ridges 42 in the mounting land 30 of the first jaw 16. A deeper ridge 57 is provided in the second jaw 18 located generally opposite the deeper ridge 43 in the first jaw 16.

The following arrangement is preferable for attaching the first jaw 16 to the second jaw 18. A compression spring 58 is interposed between the valley 32 of the first jaw 16 and the attachment land 50 of the second jaw 18 so that the spring 58 is generally coaxially aligned with the apertures 40 and 55. A jaw tightening screw 60 is then inserted from the outer surface 26 of the second jaw 18 through the aperture 55, the spring 58, and the aperture 40 in the first jaw 16, and is received by a thumb nut 62. As a result, the spring 58 biases the first jaw 16 and second jaw 18 apart, but actuation of the thumb nut 62 allows a user to defeat the spring 58 to bring the first jaw 16 and second jaw 18 together about the protruding lands 34 and 50 until the mounting lands 30 and 48 are closed about spectacles or other objects. The jaw tightening screw 60 is preferably restrained against rotation when the thumb nut 62 is rotated by complementarily threading the aperture 55 and/or cementing or otherwise affixing the screw 60 within aperture 55. The use of a spring-biased threaded adjustment between the first jaw 16 and second jaw 18 is recommended because it allows for easy placement of the jaws 16 and 18 about objects, since the jaws can be set partially open by a predetermined distance to accommodate particular objetcts; very precise adjustment of the spacing of the first and second jaws 16 and 18 can be obtained by use of only a single hand; and it also provides an extremely tight positive grip on an object located between the mounting lands 30 and 48. It is noted that the aperture 40 is preferably formed with a slightly oval or elliptical shape, as is best illustrated in FIG. 2, to prevent interference between the jaw tightening screw 60 and the first jaw 16 when the first jaw 16 is biased apart from the second jaw 18.

Without the use of the jaw tightening screw 60, the jaws 16 and 18 would automatically tend to travel to a fully open position (or alternatively a fully closed position if the spring is configured to pull the jaws 16 and 18 inward). This would make the jaws 16 and 18 difficult to install on spectacles or other head- or body-mounted apparata with only a single hand unless they included wings/grips protruding past the pivot axis P-P to allow actuation of the jaws 16 and 18 in pivot-like fashion. The addition of such wings/grips would undesirably increase the weight and size of the mount, particularly where a strong spring is used to provide a better grip between jaws 16 and 18 because in this case longer (and heavier) wings/grips are required in order to provide the user with sufficient leverage to open the jaws 16 and 18. Use of the jaw tightening screw 60 is also recommended because ordinary spring-loaded jaws are only capable of exerting a closing or opening force which is directly proportional to the distance that the spring is extended or compressed, while the jaw tightening screw 60 allows the jaw force to be adjusted to any desired degree. It should be noted that even where the prior art mounts are designed for attachment on particular types and brands of head- and body-mounted apparata, they invariably tend to experience a large amount of slippage and repositioning on the mounts owing to their size, weight, and low grip strength. However, because the mount 10 provides a much firmer grip on spectacles than prior art mounts, with a much greater resistance to inadvertent repositioning, it is well suited for this purpose and is believed to perform better than any other removable mount so far known to the art.

A mounting yoke 14 is then provided to attach the first and second jaws 16 and 18 to the illuminator 200. The mounting yoke 14 has a pivot end 66 including a generally rounded outer surface 68 and a yoke hub aperture 70. The pivot end 66 is adapted to fit between the hubs 36 and the sleeves 52 so that a fastener inserted within the hub aperture 44 will retain the pivot end 66 of the mounting yoke 14 in pivotable relation with the first and second jaws 16 and 18. The mounting yoke 14 further includes an extension arm 72 connecting the pivot end 66 to a clevis end 73 whereupon a clevis 74 is situated. The clevis 74 is sized to pivotably retain the mounting base 204 of the illuminator 200 by means of a fastener 76 and nut 78. Owing to the pivoting attachment at the opposing ends of the mounting yoke 14, the illuminator 200 is attached to the first and second jaws 16 and 18 with three degrees of freedom of movement.

The mounting yoke 14 can be mounted between the hubs 36 by simply inserting a fastener 80 and nut 82 through the hub apertures 44 and the yoke hub aperture 70, but a number of additional items are preferably interposed between the fastener 80 and nut 82 to provide for a greater range of slip-free positioning of the mounting yoke 14. Initially, a pair of hub plugs 84 are each individually located adjacent the head 86 of the fastener 80 and the nut 82. The hub plugs 84 are shaped to fit complementarily within the noncircular (e.g., hexagonal) hub apertures 44 so that the hub plugs 84 do not rotate with respect to the hubs 36. The concave ends 88 of the hub plugs 84 receive the fastener head 86 and the nut 82. The concave ends 88 are preferably shaped to complementarily receive the nut 82 therein so that the nut 82 cannot rotate when the fastener 80 is rotated. A pair of washers 90 are then included between the hub plugs 84, and these washers 90 are preferably made of an elastomeric or other high-friction material. Between the washers 90 are interposed another pair of washers 92 which are preferably concave in shape (i.e., Belleville washers) so that the rims 94 or bases 96 of these washers 92 can be placed in abutment. As a result, when the washers 92 are forced against each other, they tend to act as a disk spring. Further, the use of an elastomeric material for the washers 90 tends to enhance the resilient compressibility of the washer 90/washer 92 combination. Therefore, when the fastener 80 and nut 82 are tightened about the hub plugs 84 and the washers 90 and 92 with the pivot end 66 of the mounting yoke 14 interposed between the hubs 36, the pivot end 66 is tightly gripped. This arrangement tends to resist pivoting of the mounting yoke 14, but a user may defeat this resistance and position the mounting yoke 14 as desired. Additionally, this arrangement is believed to provide a greater dynamic range of positioning of the mounting yoke 14, that is, the mounting yoke 14 will be able to be more finely and fluidly positioned over a greater range of angles with stronger resistance to repositioning. This is to be contrasted with the use of an ordinary clevis arrangement to hold the mounting yoke 14 between the hubs 36. When an ordinary clevis arrangement is used, tightening the hubs 36 against the pivot end 66 of the mounting yoke 14 provides greater resistance to repositioning of the mounting yoke 14, but the resulting friction between the hubs 36 and the pivot end 66 also makes the mounting yoke 14 harder to finely position because it will tend to "snap" incrementally in small arcs about the hubs 36 when it is moved owing to sticking friction. Further, use of only a standard nut and bolt to affix the pivot end 66 of the mounting yoke 14 to the hubs 36 is not recommended since pivoting will occur quite frequently at this point, and repeated pivoting can cause annoying loosening and tightening of a nut and bolt. This may make the mounting yoke 14 droop during use (or may alternatively make it difficult to reposition), whereas the preferred assembly described above does not suffer from these flaws.

As an example of the usage of the mount 10, it may be attached on the nosebridge of spectacles so that the illuminator 200 provides coaxial illumination along the user's line of sight. The nosebridge is located between the mounting lands 30 and 48 of the first and second jaws 16 and 18, and the thumb nut 62 may be used to adjust the first and second jaws 16 and 18 of the clip 12 to a desired degree of tightness about the nosebridge. When the nosebridge is fit between the mounting lands 30 and 48 against the lips 28 and 46, the clip 12 fits so closely against the nosebridge that a user generally cannot feel it against the top of his or her nose. The mounting yoke 14 may be very finely adjusted about the hubs 36 in three degrees of freedom to a desired angle and position.

To hold the illuminator cord 206 out of the user's field of view, an illuminator cord retention bracket 98 may be included. The cord retention bracket 98 includes a base 100 which fits within the slot 38 on the outer surface 22 of the first jaw 16. The base 100 has an aperture 102 wherein the jaw tightening screw 60 may be fit, thereby allowing the base 100 to be clamped within the slot 38 by tightening the thumb nut 62. A leg 104 then protrudes from the base 100 to terminate in a hook 106 which is sized to loosely engage the illuminator cord 206 so that the cord can slide therein when the illuminator 200 is pivoted. Alternatively, the hook 106 can be made to tightly engage the illuminator cord 206, and the user can provide a small amount of slack cord between the hook 106 and the illuminator mounting base 204. When this arrangement is used and the illuminator cord 206 is fit within the hook 106, tension on the illuminator cord 206 is isolated from the mounting yoke 14, and therefore the illuminator 200 will not pivot out of position if the illuminator cord 206 is pulled at a point prior to the hook 106.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, the head 86 of the fastener 80 may be modified into a form similar to the thumb nut 62 to allow the user to more readily tighten the engagement between the mounting yoke 14 and the hubs 36.

Second, the function of the nut 82 may be provided by a modified hub plug which is threaded to allow replacement of the nut 82 and a hub plug 84 with a single component. A similar arrangement can be provided by gluing or otherwise affixing the nut 82 within the hub plug 84.

Third, while use of both the washers 90 and the washers 92 provides the mounting yoke 14 with an especially preferred dynamic range of positioning about the hubs 36, use of both of the washers 90 and the washers 92 is not necessary and one or both of them can be omitted from the invention. This can result in less preferable frictional properties between the mounting yoke 14 and the hubs 36 and a less preferred "feel" when the mounting yoke 14 is being repositioned, but the arrangement is still superior to a standard clevis attachment.

Fourth, washers similar to the washers 90 and/or 92 may be used in conjunction with the fastener 76 to allow the clevis 74 to be finely tightened about the mounting base 204 of the illuminator 200. The fastener 76 can bear wings or an enlarged knurled head, or can be used with a nut 78 similar to the thumb nut 62, to allow for easier adjustability by users.

Fifth, the washers 90 and 92 need not be provided only between the hub plug 84 and the mounting yoke 14. The positions of the washers 90 and 92 can be changed so that the washers 90 and 92 are interposed between different pairs of the fastener 80, the hub plugs 84, the mounting yoke 14, and the nut 82.

Sixth, the mounting yoke 14 could be omitted, and that the illuminator 200 could be mounted directly between the hubs 36 at its mounting base 204. This would, however, reduce the range of motion of the illuminator 200 by two degrees of freedom.

Seventh, while the sleeves 52 are shown as being partial sleeves which encounter the stop land 39 and thereby limit the ability of the jaws 16 and 18 to open, the stop land can be omitted and the sleeves 52 may fully encircle the hubs 36. The use of the partial sleeves 52 and stop land 39 are preferred because they limit opening of the jaws 16 and 18 to a useful effective range (and deter loosening of the thumb nut 62 to such an extent that the jaw tightening screw 60 comes loose), but they are not essential.

Eighth, rather than providing a spring 58 which normally biases the jaws 16 and 18 apart, a spring can be provided which biases the jaws 16 and 18 together. In this case, the jaw tightening screw 60 can engage one or both of the jaw apertures 40 and/or 55 so that rotation of the screw 60 can defeat the spring to move the jaws 16 and 18 apart. In this instance, it would be preferable to provide the screw 60 with an easily-grasped head similar to the thumb nut 62 to allow easier actuation of the screw 60. Regardless of whether the spring biases the jaws normally open or normally closed, leaf, flat, torsion or other springs can be used in place of the coil spring illustrated in the drawings.

Ninth, the mount 10 could be used to mount devices other than illuminators 200 to spectacles. In particular, the mount 10 is advantageous for mounting accessory optics to spectacles. As an example, the mount 10 could be utilized to mount DIMENSION-3 binocular telescopes (Orascoptic Research, Inc., Madison, Wis., USA) in front of a user's spectacles so that the user can selectively position and remove the telescopes in front of the user's spectacles.

Tenth, the mount 10 could be used to mount illuminators, accessory optics, and the like to headbands or other head-mounted apparata apart from spectacles. This makes the mount 10 especially versatile because prior mounts are unable to accommodate structures other than spectacle frames, and thus they cannot be used with headbands.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. An apparatus comprising:

a. a clip having a pair of jaws; said clip pivotable about a pivot axis, b. a mounting yoke having a clevis for engaging an optical device and an opposing pivot end, the pivot end being pivotably mounted to the clip to rotate about the pivot axis.

2. The apparatus of claim 1 wherein the jaws each bear a yoke slot intersecting the pivot axis, the pivot end of the mounting yoke being pivotably mounted within the yoke slot.

3. The apparatus of claim 2 further comprising:

a. a fastener extending along the pivot axis and affixing the clip to the mounting yoke, b. at least one compressible washer borne on the fastener, the washer exerting force along the pivot axis when compressed.

4. The apparatus of claim 3 further including a hub wherein the fastener extends within a hub aperture in the hub, the hub aperture having a non-circular cross section along at least a portion of its length, the apparatus further comprising a hub plug formed to complementarily fit within the non-circular portion of the hub aperture.

5. The apparatus of claim 4 wherein the compressible washer is situated between the hub plug and the pivot end of the mounting yoke.

6. The apparatus of claim 3 wherein the compressible washer is formed of elastomeric material.

7. The apparatus of claim 3 wherein the washer is concave and formed of a resiliently flexible material.

8. The apparatus of claim 2 wherein the pivot end of the mounting yoke is pivotably mounted in the yoke slot, and wherein the apparatus further comprises resistance means interposed between the pivot end and the clip for exerting a compressive force on the pivot end thereby resisting pivoting of the mounting yoke.

9. The apparatus of claim 2 wherein the jaws have a lateral width measured parallel to the pivot axis, and wherein the yoke slot is generally centrally located within the lateral width of the jaws.

10. The apparatus of claim 3 wherein the pair of jaws includes a first jaw having a hub and a second jaw having a sleeve at least partially encircling the hub, the sleeve thereby having a path of rotation about the hub, the first jaw being spring-biased with respect to the second jaw.

11. The apparatus of claim 10 further comprising a jaw tightening screw engaging the first and second jaws, the jaw tightening screw being actuable to move the first and second jaws into closed relation.

12. The apparatus of claim 11 further comprising a spring concentrically surrounding the screw between the first and second jaws.

13. The apparatus of claim 11 wherein the sleeve of the second jaw partially encircles the hub of the first jaw, and wherein the first jaw includes a stop land protruding from the hub within the path of rotation of the sleeve about the hub, the stop land thereby serving to limit rotation of the sleeve about the hub.

14. The apparatus of claim 1 wherein the jaws are spring-biased with respect to each other.

15. The apparatus of claim 14 further comprising a jaw tightening screw engaging the first and second jaws, the jaw tightening screw being actuable to move the first and second jaws into closed relation.

16. The apparatus of claim 1 further comprising an illuminator cord retention bracket affixed to the clip, the retention bracket being spaced from the clip by an elongated leg.

17. The apparatus of claim 1 wherein the optical device is pivotally mounted in the clevis of the mounting yoke and spectacles affixed between the jaws of the clip.

18. An apparatus comprising:

a. a clip including a first jaw and a second jaw pivotably affixed to the first jaw so as to rotate about a pivot axis, the jaws being spring-biased with respect to each other, and further including a jaw tightening screw engaging the first and second jaws which actuates the jaws when rotated;

b. a mounting yoke including a pivot end pivotably affixed to the clip, and an opposing clevis end pivotably engaging an illuminator.

19. The apparatus of claim 18 wherein the jaws having a lateral width measured parallel to the pivot axis, and wherein the mounting yoke pivots within a plane located centrally within the lateral width of the jaws.

20. An apparatus comprising:

a. a clip having opposing first and second jaws affixed about a pivot axis, the jaws being spring-biased with respect to each other;

b. a mounting yoke including a pivot end pivotably affixed to the clip to rotate about the pivot axis, and an opposing clevis end including a clevis pivotably engaging an illuminator; and c. an illuminator cord retention bracket affixed to the clip.

21. The apparatus of claim 20 further including a jaw tightening screw engaging the first and second jaws which actuates the jaws when rotated.

* * * * *